US010960255B2

(12) United States Patent
Bourke et al.

(10) Patent No.: US 10,960,255 B2
(45) Date of Patent: Mar. 30, 2021

(54) EASY CHAIR EXERCISER

(71) Applicants: William Thomas Bourke, Evergreen Park, IL (US); Lisa Therese Bourke, Evergreen Park, IL (US)

(72) Inventors: William Thomas Bourke, Evergreen Park, IL (US); Lisa Therese Bourke, Evergreen Park, IL (US)

( * ) Notice: Subject to any disclaimer, the term of this patent is extended or adjusted under 35 U.S.C. 154(b) by 85 days.

(21) Appl. No.: 16/380,707

(22) Filed: Apr. 10, 2019

(65) Prior Publication Data

US 2019/0314668 A1 Oct. 17, 2019

Related U.S. Application Data

(60) Provisional application No. 62/656,307, filed on Apr. 11, 2018.

(51) Int. Cl.

| | |
|---|---|
| ***A63B 21/16*** | (2006.01) |
| ***A63B 21/04*** | (2006.01) |
| ***A63B 21/00*** | (2006.01) |
| ***A63B 21/055*** | (2006.01) |
| *A47C 9/00* | (2006.01) |
| *A63B 23/04* | (2006.01) |

(52) U.S. Cl.

CPC ..... *A63B 21/1609* (2015.10); *A63B 21/0442* (2013.01); *A63B 21/0557* (2013.01); *A63B 21/4011* (2015.10); *A63B 21/4035* (2015.10); *A47C 9/002* (2013.01); *A63B 21/00058* (2013.01); *A63B 21/4045* (2015.10); *A63B 23/0417* (2013.01); *A63B 2208/0228* (2013.01)

(58) Field of Classification Search

CPC ..... A63B 21/1609; A63B 21/0442; A63B 21/0557; A63B 21/4035; A63B 21/4011; A63B 21/4034; A63B 21/00047; A63B 21/00058; A63B 21/012; A63B 21/4045; A63B 2208/0228; A63B 2225/09; A63B 2210/02; A63B 2022/0033; A63B 2022/0038; A63B 23/0417; A47C 9/002

See application file for complete search history.

(56) References Cited

U.S. PATENT DOCUMENTS

| | | | | |
|---|---|---|---|---|
| 4,913,423 | A * | 4/1990 | Farran | A63B 21/023 297/217.1 |
| 4,921,247 | A * | 5/1990 | Sterling | A63B 17/00 482/130 |
| 5,470,298 | A * | 11/1995 | Curtis | A63B 23/03516 482/130 |
| 5,755,650 | A | 5/1998 | Urso | |
| 5,921,900 | A | 7/1999 | Mankovitz | |
| 7,303,513 | B1 * | 12/2007 | Curtiss | A47C 7/62 482/130 |
| 7,648,447 | B2 * | 1/2010 | Andre | A63B 23/0417 482/60 |
| 9,283,428 | B1 * | 3/2016 | Esrick | A63B 21/00069 |

(Continued)

*Primary Examiner* — Megan Anderson

(74) *Attorney, Agent, or Firm* — Inspired Idea Solutions Law Firm

(57) ABSTRACT

An exercise device is disclosed herein. The exercise device includes a platform, a track unit, a first leg holder, a second leg holder and a bracket. Further the exercise device includes a first resistance band and a second resistance band. The exercise device can be moved from any recliner or ottoman with ease to assist users in strengthening the legs and upper body whilst sitting.

20 Claims, 5 Drawing Sheets

(56) References Cited

U.S. PATENT DOCUMENTS

| | | | | |
|---|---|---|---|---|
| 10,143,885 | B2 * | 12/2018 | DuMee | A63B 21/4043 |
| 10,569,124 | B2 * | 2/2020 | Dalmia | A63B 22/0664 |
| 2007/0111869 | A1 | 5/2007 | Wallach | |
| 2011/0251033 | A1 | 10/2011 | Blancher | |
| 2014/0011639 | A1 | 1/2014 | Reade | |
| 2014/0155232 | A1 | 6/2014 | Wolan | |
| 2018/0339190 | A1 * | 11/2018 | Bailar | A63B 1/00 |
| 2020/0061410 | A1 * | 2/2020 | Hildebrandt | A63B 21/4045 |

* cited by examiner

EASY CHAIR EXERCISER

CROSS REFERENCE TO RELATED APPLICATION

The present application is related to and claims priority to U.S. Provisional Patent Application No. 62/656,307 filed Apr. 11, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of exercise equipment and more specifically relates to exercise equipment for attachment to a chair.

2. DESCRIPTION OF RELATED ART

To workout, individuals are typically forced to leave their home. They often have to pay and join a fitness center and individuals who are in need of physical therapy have to attempt to make it to multiple appointments outside the home. It is not always an option for some individuals to travel in order to exercise. However, buying a collection of equipment for the home is expensive. An alternative is needed.

U.S. Pat. No. 5,921,900 to Roy J. Mankovitz relates to an exercise apparatus for use with conventional chairs. The described exercise apparatus for use with conventional chairs includes a plurality of resilient members attached to the chair with a chain or other conventional means and attached to a foot support bar which can be pushed away from the chair by an occupant of the chair, stretching the resilient members and thereby exercising the occupant.

BRIEF SUMMARY OF THE INVENTION

In view of the foregoing disadvantages inherent in the known exercise equipment art, the present disclosure provides a novel easy chair exerciser. The general purpose of the present disclosure, which will be described subsequently in greater detail, is to provide a mobile exercise device that can be moved from any recliner or ottoman with ease to assist users in strengthening their legs and upper body whilst sitting.

An exercise device is disclosed herein. The exercise device includes a platform which may include an elongated body having a horizontal-length relative to a horizontal axis; and a track unit. A first leg holder may be moveably attached to the platform via the track unit and configured to move along the track unit in the horizontal axis. Similarly, a second leg holder may be moveably attached the platform via the track unit opposite the first leg holder and configured to move along the track unit in the horizontal axis. Further, a bracket may be provided for attaching the platform to a chair.

A method of using exercise device is also disclosed herein. The method of using exercise device may comprise the steps of: providing the exercise device as above; sitting on the chair; attaching the bracket to the chair; placing a first leg in the first leg holder; placing a second leg in the second leg holder; and moving the first leg holder and the second leg holder along the horizontal axis via the track unit.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an easy chair exerciser, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to exercise equipment and more particularly to an easy chair exerciser as used to improve the exercise equipment for attachment to a chair.

Generally, disclosed is a device designed to allow individuals to lose weight and gain strength while sitting in a chair/ottoman. The device may be comprised of a flat platform having a roller device and leg-receiving portion attached to the roller-device. The device may further include resistance bands and padded handles.

The platform may be a flat piece of solid material having gliders on the top for a user to place their ankles or calves.

These gliders may allow for outward motion. Tension of the gliders may be adjusted using adjustable knobs. The resistance bands may be used for the upper body. The exact specifications may vary.

The device may provide varying tensions to accommodate individuals of varying strengths and abilities and may allow for low impact strengthening for leg and arm therapy. As designed the device may enable users to remain seated in a chair while using the device, making it an ideal option for individuals suffering from limited mobility. The present device may afford users the ability to gain strength and lose weight while in the comfort of their own home.

Referring now more specifically to the drawings by numerals of reference, there is shown in FIGS. 1-5, various views of an exercise device 100.

Figure 1:
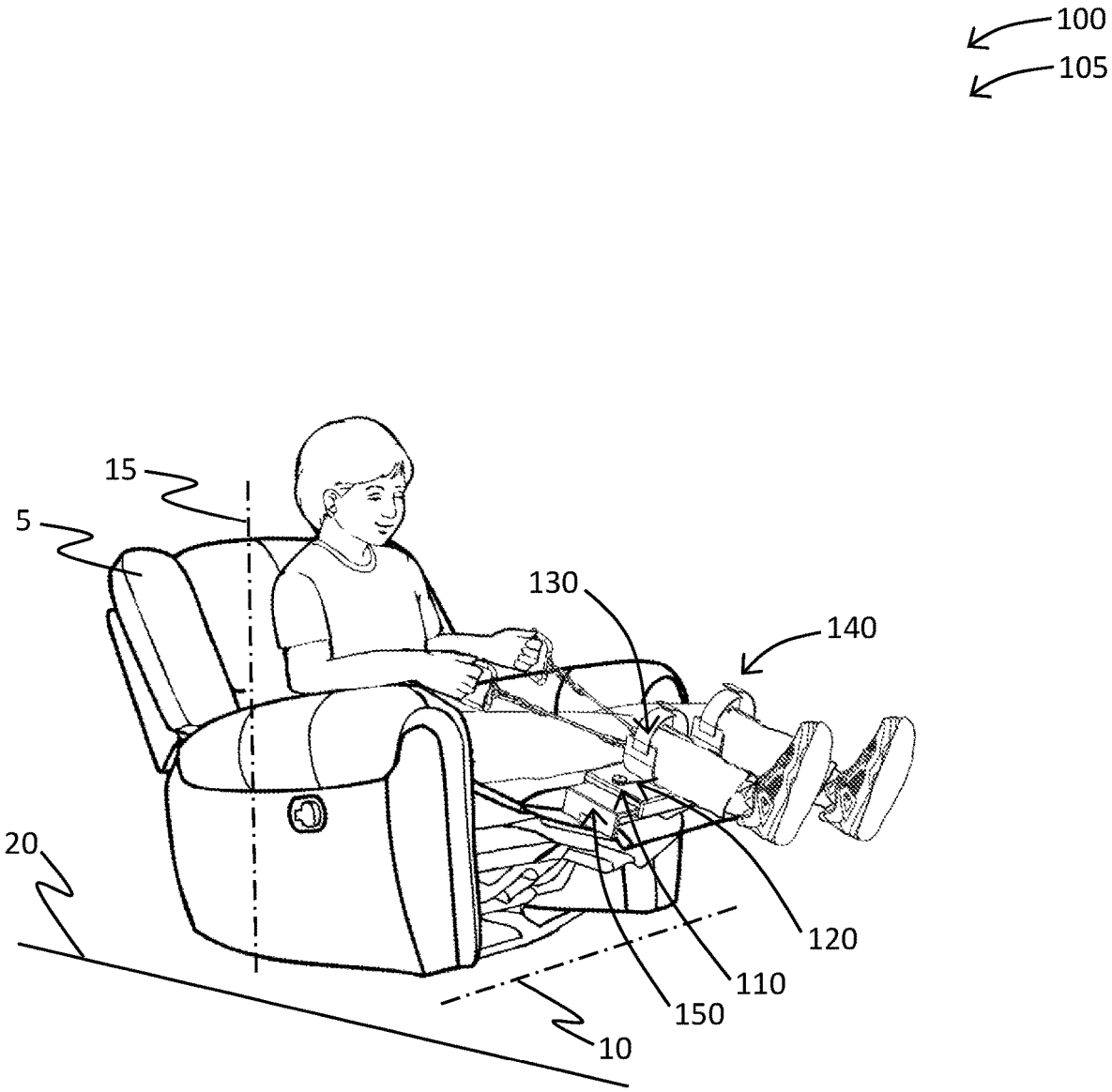
FIG. 1 is a front side perspective view of the exercise device during an 'in-use' condition, according to an embodiment of the disclosure.

FIG. 1 shows an exercise device 100 during an 'in-use' condition 105, according to an embodiment of the present disclosure. As illustrated, the exercise device 100 may include a platform 110, a track unit 120, a first leg holder 130, a second leg 140, and a bracket 150. As shown, the exercise device 100 may be used for attachment to a chair 5. The chair 5 defining a horizontal-axis 10 and a vertical-axis 15 relative to a floor-surface 20 on which the chair 5 is placed.

Figure 2A:
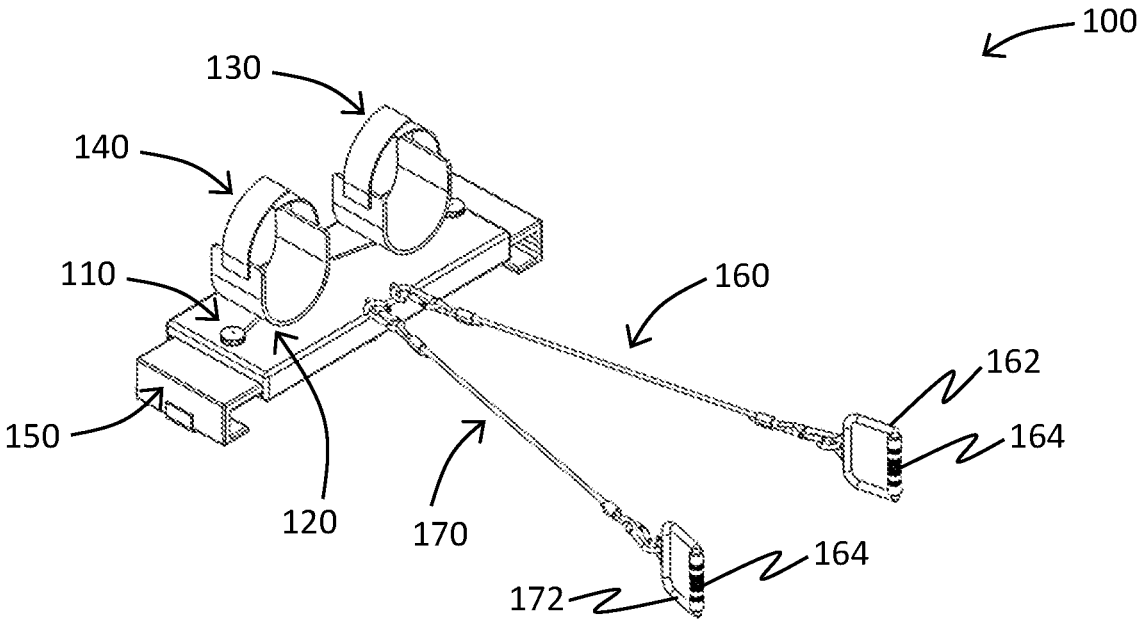
FIG. 2A is a side rear perspective view of the exercise device of FIG. 1, according to an embodiment of the present disclosure.
Figure 2B:
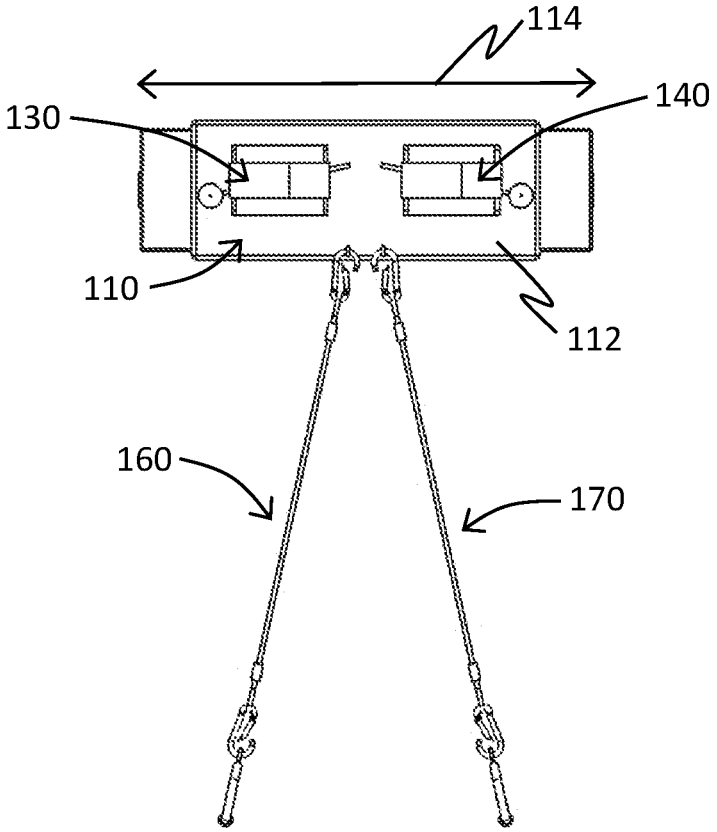
FIG. 2B is a top perspective view of the exercise device of FIG. 1, according to an embodiment of the present disclosure.

FIGS. 2A-2B show side rear and top perspective views of the exercise device 100 of FIG. 1, according to an embodiment of the present disclosure. The platform 110 may include an elongated body 112 having a horizontal-length 114 relative to the horizontal axis 10 (FIG. 1). As shown, the first leg holder 130 may be moveably attached to the platform 110 via the track unit 120 and configured to move along the track unit 120 in the horizontal axis. Similarly, the second leg holder 140 may be moveably attached the platform 110 via the track unit 120 opposite the first leg holder 130 and configured to move along the track unit 120 in the horizontal axis. As shown, the first leg holder 130 and the second leg holder 140 may include a curved shape configured to conform a section of a user's leg. The section of the user's leg may be their calf or ankle. Preferably, the first leg holder 130 and the second leg holder 140 may be substantially U-shaped to accommodate a curvature of the section of the user's leg.

Further, as shown, the exercise device 100 may further include a first resistance band 160 attached to the platform 110, and a second resistance band 170 attached to the platform 110. In one embodiment, the first resistance band 160 may be adjacent to the second resistance band 170 (as shown). In other embodiments, the first resistance band 160 and the second resistance band 170 may be placed in different areas than what is shown in order to provide resistance in different ways to different muscles. The first resistance band 160 may include a first handle 162 and the second resistance band 170 may include a second handle 172 to aid in use of the first and second resistance bands. In addition, the first handle 162 and the second handle 172 may include a padded material 164 to provide comfort to the user. In some embodiments, the first handle 162 and the second handle 172 may also include finger grooves for providing better grip and comfort.

Figure 3:
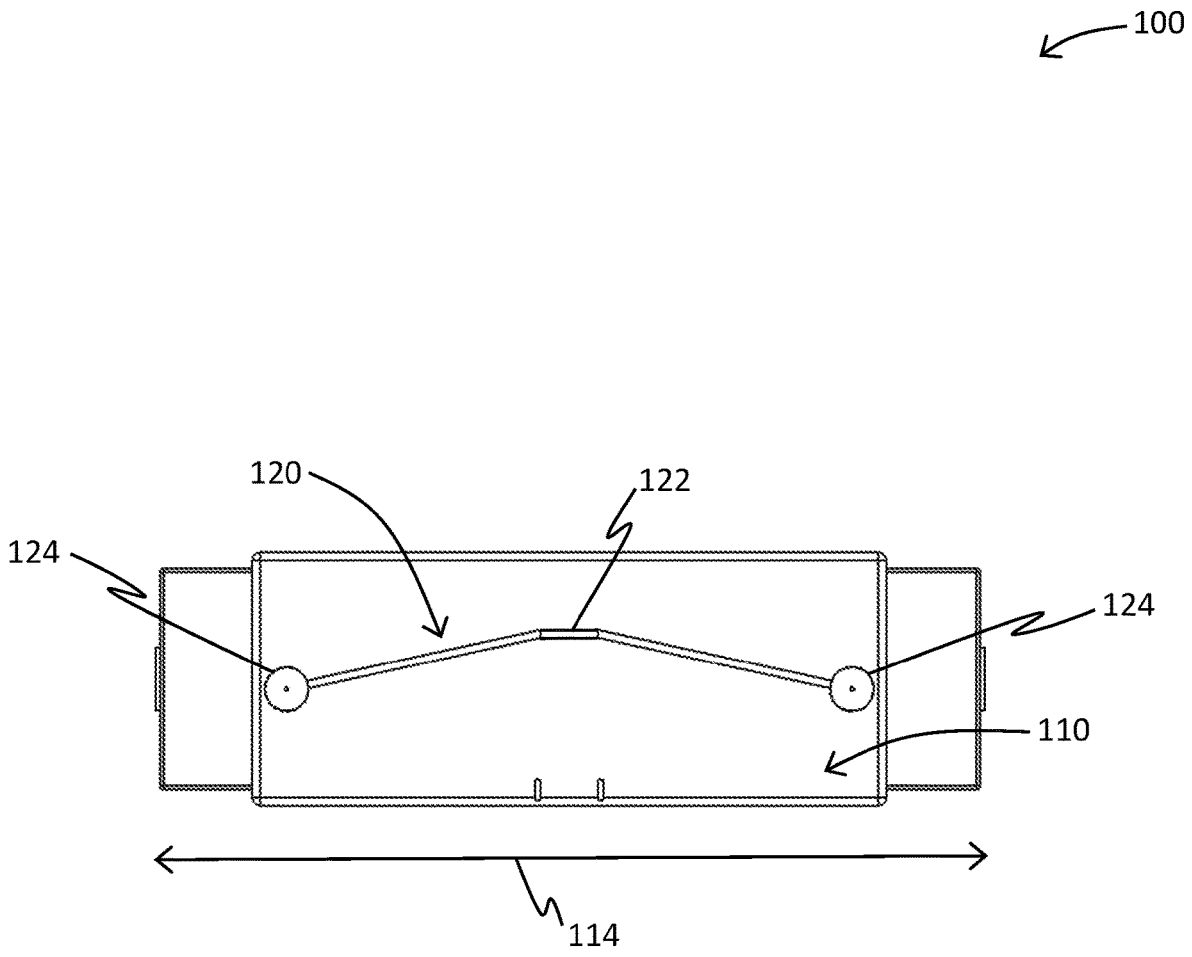
FIG. 3 is a top perspective view of the exercise device of FIG. 1, according to an embodiment of the present disclosure.

FIG. 3 shows a top perspective view of the exercise device 100 of FIG. 1, according to an embodiment of the present disclosure. Demonstrated here is the track unit 120, shown disposed within the platform 110. The track unit 120 may include an elongated aperture 122 in the horizontal axis. As shown, it may run along the horizontal-length 114 of the platform 110. In one embodiment, the elongated aperture 122 may include a substantially arcuate profile. Preferably, the elongated aperture 122 may be configured to provide resistance to the first leg holder 130 (FIG. 2A) and the second leg holder 140 (FIG. 2A) when moving along the horizontal axis. For example, the elongated aperture 122 may be tapered to allow for more resistance in areas along the elongated aperture, thus making it more difficult for the user to move the first leg holder 130 (FIG. 2A) and the second leg holder 140 (FIG. 2A). Further to this, the track unit 120 may include an adjustment means 124 configured to adjust resistance. Preferably, the adjustment means 124 may be a knob. In one embodiment, there may be two adjustment means 124. In one example, the knob may widen or narrow the elongated aperture 122 to provide further resistance.

Figure 4A:
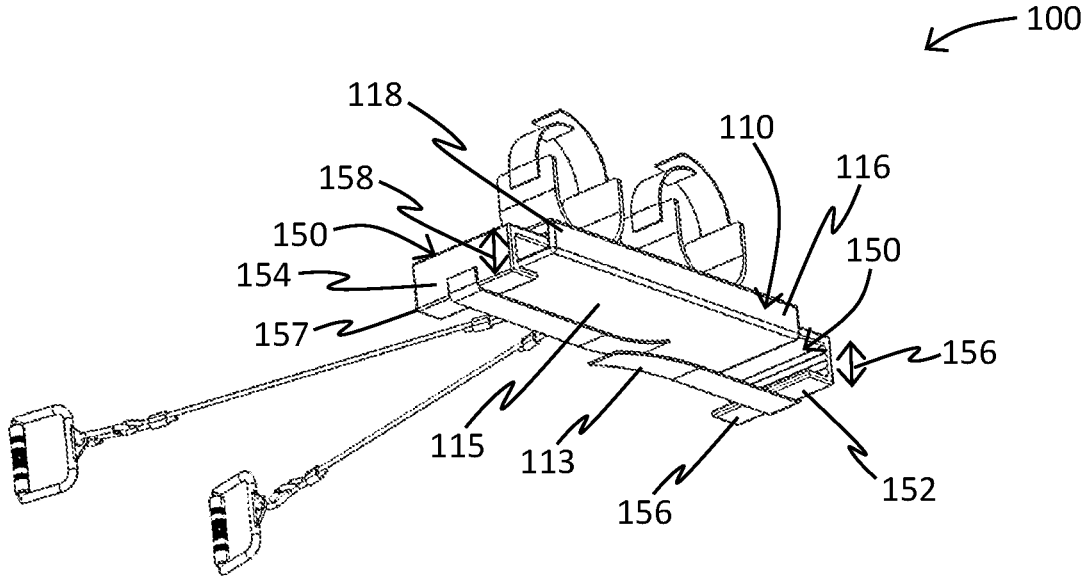
FIG. 4A is a bottom front perspective view of the exercise device of FIG. 1, according to an embodiment of the present disclosure.
Figure 4B:
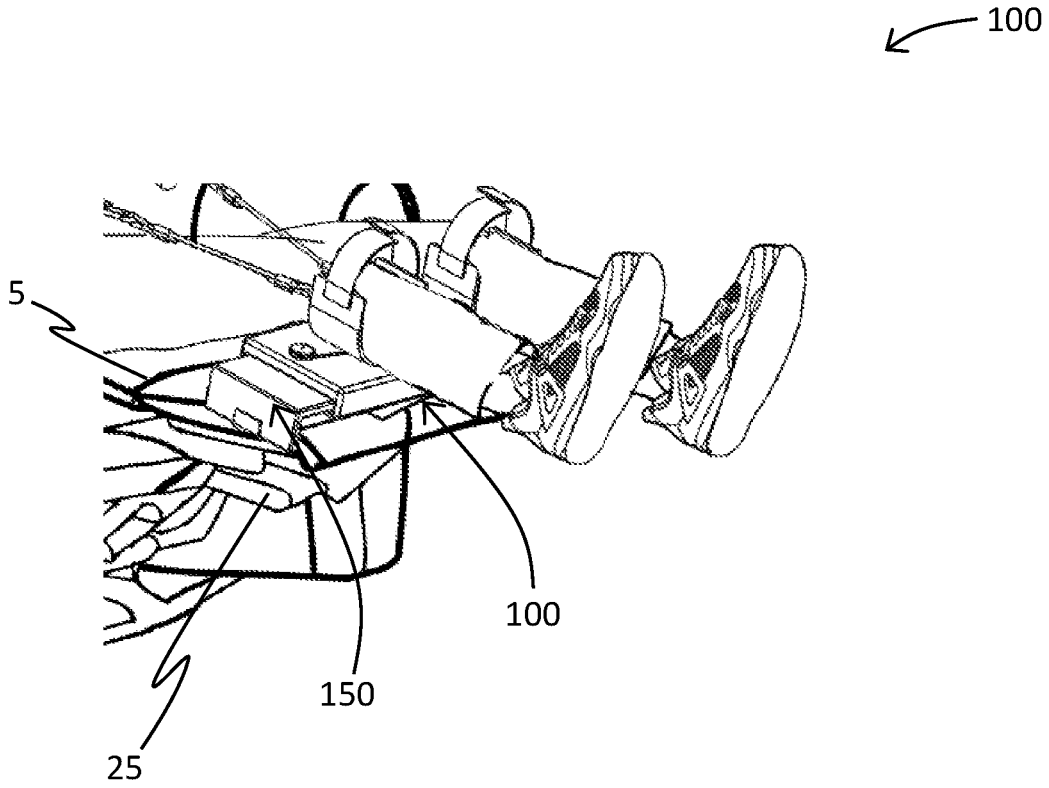
FIG. 4B is a side front perspective view of the exercise device of FIG. 1, according to an embodiment of the present disclosure.

FIGS. 4A-4B show a bottom front and side front perspective views of the exercise device 100 of FIG. 1, according to an embodiment of the present disclosure. As shown, the bracket 150 may be used for attaching the platform 110 to the chair 5. Preferably, the bracket 150 may include a first bracket-side 152 attached to a first side 116 of the platform 110, and a second bracket-side 154 attached to a second side 118 of the platform 110. The first bracket-side 152 may include a first clamp 155 including a first space 156 therebetween. Likewise, the second bracket-side 154 may include a second clamp 157 including a second space 158 therebetween. As shown here, the chair 5 may include a foot rest 25, and the first space 156 and the second space 158 may be sized to receive a thickness of the foot rest 25 in order to attach the bracket 150 to the chair 5. In one embodiment, the bracket 150 may be adjustable. Further, as shown here, the bracket 150 may further include an attachment strap 113 on a rear side 115 thereof. In one embodiment, the attachment strap 113 may wrap around the foot rest 25 of the chair 5 to further securely fasten the bracket 150 to the chair 5. The attachment strap 113 may include a fastener, such as hook and loop, hook and eye, buttons, magnets, etc.

Figure 5:
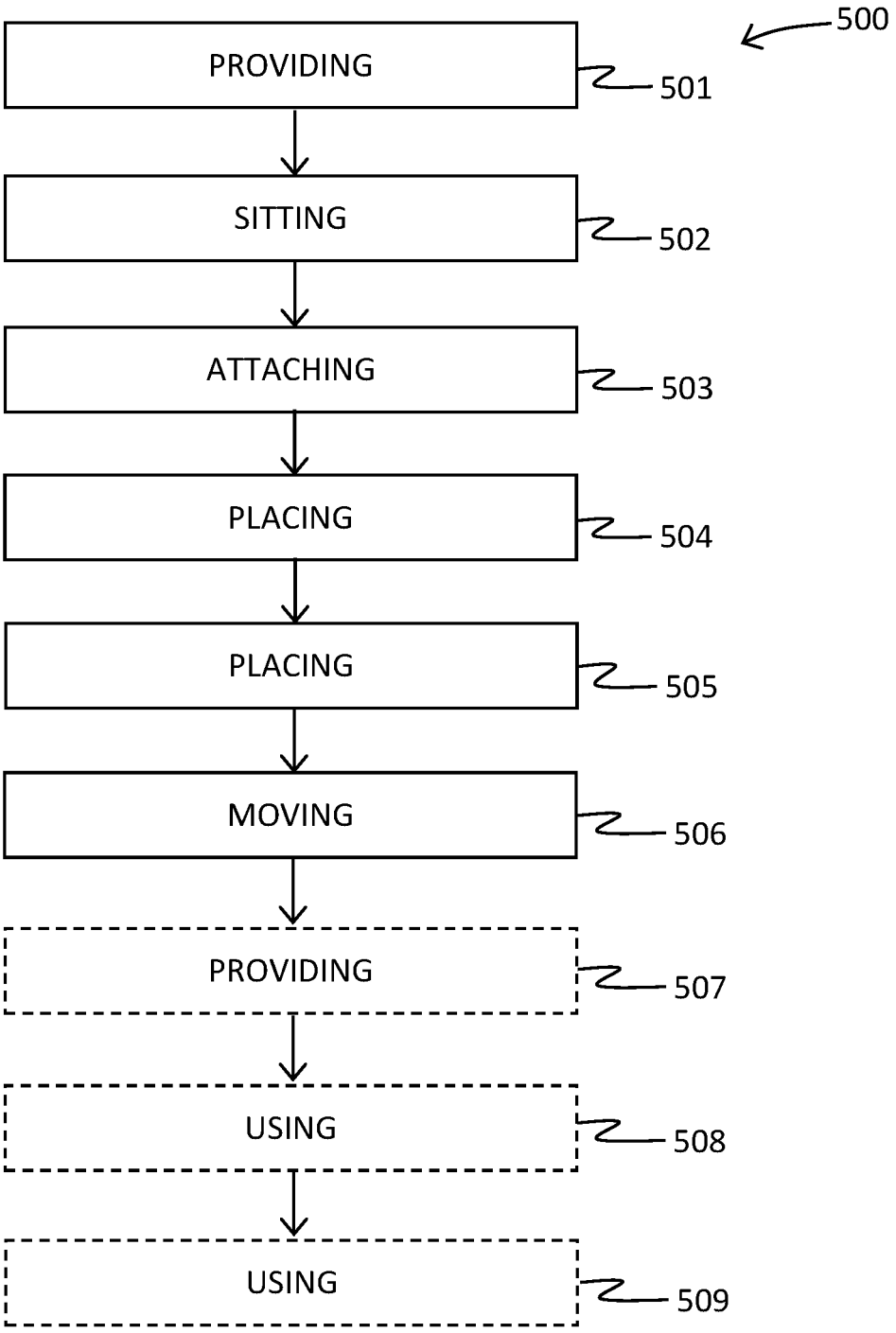
FIG. 5 is a flow diagram illustrating a method of use for exercise device, according to an embodiment of the present disclosure.

FIG. 5 is a flow diagram illustrating a method of using an exercise device 500, according to an embodiment of the present disclosure. As illustrated, the method of using an exercise device 500 may include the steps of: providing 501 the exercise device as above; sitting 502 on the chair; attaching 503 the bracket to the chair; placing 504 a first leg in the first leg holder; placing 505 a second leg in the second leg holder; and moving 506 the first leg holder and the second leg holder along the horizontal axis via the track unit. Further steps may include: providing 507 the exercise device further including the first resistance band attached to the platform, and the second resistance band attached to the platform; using 508 the first resistance band with a first hand; and using 509 the second resistance band with a second hand.

It should be noted that steps 507, 508 and 509 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for exercise device 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An exercise device for attachment to a chair, the chair defining a horizontal axis and a vertical axis relative to a floor surface on which the chair is placed, the exercise device comprising:

a platform including an elongated body, the elongated body having a horizontal length relative to the horizontal axis;

a track;

a first leg holder moveably attached to the platform via the track, the first leg holder configured to move along the track in the horizontal axis;

a second leg holder moveably attached the platform via the track, the second leg holder opposite the first leg holder, the second leg holder configured to move along the track in the horizontal axis; and a bracket for attaching the platform to the chair.

2. The exercise device of claim 1, wherein the track includes an elongated aperture in the horizontal axis.

3. The exercise device of claim 2, wherein the elongated aperture is configured to provide resistance to the first leg holder and the second leg holder when moving along the horizontal axis.

4. The exercise device of claim 3, wherein the track includes an adjustment means configured to adjust resistance.

5. The exercise device of claim 4, wherein the adjustment means is a knob.

6. The exercise device of claim 2, wherein the elongated aperture includes an arcuate profile.

7. The exercise device of claim 1, further comprising a first resistance band attached to the platform and a second resistance band attached to the platform.

8. The exercise device of claim 7, wherein the first resistance band includes a first handle; and wherein the second resistance band includes a second handle.

9. The exercise device of claim 8, wherein the first handle and the second handle each include a padded material.

10. The exercise device of claim 7, wherein the first resistance band is adjacent to the second resistance band.

11. The exercise device of claim 1, wherein the bracket includes a first bracket-side attached to a first side of the platform; and a second bracket-side attached a second side of the platform.

12. The exercise device of claim 11, wherein the first bracket-side includes a first clamp, wherein the first clamp includes a first space therebetween, wherein the second bracket-side includes a second clamp, and wherein the second clamp includes a second space therebetween.

13. The exercise device of claim 12, wherein the chair includes a foot rest, and wherein the first space and the second space are sized to receive a thickness of the foot rest.

14. The exercise device of claim 11, wherein the first bracket-side includes a first clamp, and wherein the first clamp includes a first space therebetween.

15. The exercise device of claim 1, wherein the first leg holder and the second leg holder each include a curved shape configured to conform to a section of a user's leg.

16. The exercise device of claim 15, wherein the first leg holder and the second leg holder are U-shaped.

17. The exercise device of claim 1, further comprising a first resistance band attached to the platform.

18. An exercise device for attachment to a chair, the chair defining a horizontal axis and a vertical axis relative to a floor surface on which the chair is placed, the exercise device comprising:

a platform including an elongated body, the elongated body having a horizontal length relative to the horizontal axis;

a track unit;

a first leg holder moveably attached to the platform via the track unit, the first leg holder configured to move along the track unit in the horizontal axis;

a second leg holder moveably attached the platform via the track unit, the second leg holder opposite the first leg holder, the second leg holder configured to move along the track unit in the horizontal axis;

a bracket for attaching the platform to the chair;

a first resistance band attached to the platform; and a second resistance band attached to the platform; and wherein the first resistance band is adjacent to the second resistance band;

wherein the first resistance band includes a first handle; and wherein the second resistance band includes a second handle;

wherein the first handle and the second handle include a padded material;

wherein the track unit includes an elongated aperture in the horizontal axis;

wherein the elongated aperture includes an arcuate profile;

wherein the elongated aperture is configured to provide resistance to the first leg holder and the second leg holder when moving along the horizontal axis;

wherein the track unit includes an adjustment means configured to adjust resistance;

wherein the adjustment means is a knob;

wherein the first leg holder and the second leg holder each include a curved shape configured to conform to a section of a user's leg;

wherein the first leg holder and the second leg holder are U-shaped;

wherein the bracket includes a first bracket-side attached to a first side of the platform;

and a second bracket-side attached a second side of the platform;

wherein the first bracket-side includes a first clamp, and wherein the first clamp includes a first space therebetween;

wherein the second bracket-side includes a second clamp, and wherein the second clamp includes a second space therebetween; and wherein the chair includes a foot rest, and wherein the first space and the second space are sized to receive a thickness of the foot rest.

19. A method of using an exercise device for attachment to a chair, the chair defining a horizontal axis and a vertical axis relative to a floor surface on which the chair is placed, the method comprising the steps of:

providing the exercise device including:

a platform including an elongated body, the elongated body having a horizontal length relative to the horizontal axis;

a track;

a first leg holder moveably attached to the platform via the track, the first leg holder configured to move along the track in the horizontal axis;

a second leg holder moveably attached the platform via the track, the second leg holder opposite the first leg holder, the second leg holder configured to move along the track in the horizontal axis; and a bracket for attaching the platform to the chair;

sitting on the chair;

attaching the bracket to the chair;

placing a first leg in the first leg holder;

placing a second leg in the second leg holder; and moving the first leg holder and the second leg holder along the horizontal axis via the track.

20. The method of claim 19, further comprising the steps of:

providing the exercise device further including a first resistance band attached to the platform, and a second resistance band attached to the platform; and using the first resistance band with a first hand; and using the second resistance band with a second hand.

* * * * *